US006064014A

United States Patent [19]

McCluskey et al.

[11] Patent Number: 6,064,014

[45] Date of Patent: May 16, 2000

[54] PRESSURE RESPONSIVE ELECTRIC SWITCH ASSEMBLY AND METHOD FOR MAKING

[75] Inventors: Claudine M. McCluskey, Bridgewater, Mass.; Gary A. Baker, North Scituate, R.I.

[73] Assignee: Texas Instruments Incorporated, Dallas, Tex.

[21] Appl. No.: 08/634,470

[22] Filed: Apr. 18, 1996

Related U.S. Application Data

[60] Provisional application No. 60/000,346, Jun. 20, 1995.

[51] Int. Cl.[7] ..... H01H 35/34

[52] U.S. Cl. ..... 200/83 J; 200/81.4; 200/83 P; 29/622

[58] Field of Search ..... 200/83 R, 83 J, 200/83 N, 83 P, 83 S, 83 SA, 83 V, 83 Y, 83 W, 82 R, 81 R, 81.4, 81.5; 29/622

[56] References Cited

U.S. PATENT DOCUMENTS

| | | | |
|---|---|---|---|
| 3,515,828 | 6/1970 | Boerner | 200/83 |
| 4,843,197 | 6/1989 | Kojima et al. | 200/406 |
| 4,861,953 | 8/1989 | Sanford | 200/83 P |
| 5,015,808 | 5/1991 | Czarn et al. | 200/83 P |
| 5,049,708 | 9/1991 | Baker | 200/83 P |
| 5,101,549 | 4/1992 | Sogge et al. | 29/622 |
| 5,280,926 | 1/1994 | Sogge et al. | 277/168 |
| 5,338,908 | 8/1994 | Rahman et al. | 200/83 P |
| 5,451,735 | 9/1995 | Worthington et al. | 200/505 |
| 5,473,937 | 12/1995 | McCluskey et al. | 73/118.1 |

*Primary Examiner*—Cassandra C. Spyrou
*Assistant Examiner*—Michael A Friedhofer
*Attorney, Agent, or Firm*—Russell E. Baumann; Richard L. Donaldson

[57] ABSTRACT

As assembly of normally open pressure responsive electric switches (10*a*–10*e*) is provided using a single lead frame (8) for forming respective discontinuous annuli (12) to serve as contact surfaces for pressure responsive discs (42) and a center contact (14) for each respective discontinuous annulus. The lead frame is overmolded with electrically insulative plastic and the circuit paths are electrically separated from one another by severing selected interconnecting runners (40). Each switching station has a disc (42) sealed by a flexible layer (47) and an O-ring (48). A separate lead (26) can be provided for adding switches of an opposite logic, i.e., normally closed, and a thermistor (38) can be included, if desired. The normally closed switches can be modular or the switches (100, 200) can have contacts formed from the lead frame (89).

12 Claims, 3 Drawing Sheets

PRESSURE RESPONSIVE ELECTRIC SWITCH ASSEMBLY AND METHOD FOR MAKING

This application claims priority under 35 USC § 119(c)(1) of provisional application number 60/000,346, filed Jun. 20, 1995.

BACKGROUND OF THE INVENTION

1. Field of the Invention

This invention relates generally to pressure responsive electric switches and more specifically to such switches particularly useful with vehicular transmissions.

2. Brief Description of the Prior Art

It is known to place pressure responsive electric switches in pressure receiving communication with hydraulic fluid in the solenoid valve assembly of a motor vehicle as a way to confirm that solenoid valve actuation and deactuation has occurred. The pressure change associated with valve actuation and deactuation can be sensed using snap acting pressure responsive switches which close or open electric circuits such as those shown in U.S. Pat. No. 4,861,953, assigned to the assignee of the present invention. In that patent, a switch assembly is shown comprising a plurality of electrical conductors overmolded with electrically insulating material and with portions of the conductors left exposed to serve as connector pins, annular disc seats and spring connectors. Runners connecting the several conductors for purposes of maintaining the conductors in a selected spatial relationship with one another during the handling and molding procedure are severed after completion of molding through apertures in the overmolded insulating material aligned with the runners. The annular disc seats are exposed on one side and supported by the insulating material on the opposite side with a stationary contact receiving bore provided through the insulating material at the center of each disc seat. An electrically conductive rivet is received in each stationary contact receiving bore and is positioned along the longitudinal axis of the bore so that an electrically conductive, snap acting disc received on the disc seat is adapted to move into and out of engagement with an end of the rivet. The disc is captured on the disc seat by a sleeve assembly which in turn is adapted to be placed in communication with a pressure source used to actuate the transmission solenoid valves.

In U.S. Pat. No. 5,015,808, also assigned to the assignee of the present invention, a plurality of discrete, modular pressure switches are mounted on a circuit board which is adapted to be secured to a hydraulic manifold such as a valve body whereby the upper surface of each pressure responsive switch abuts and is in sealing relationship with a variable pressure source in the valve body whereby such pressure causes each switch to actuate in accordance with the level of pressure then present at each switch. Use of discrete, modular switches provide an advantage of using the same switches for a number of different specific applications merely by providing an appropriate circuit board layout. However, for some applications, particularly those involving a large number of pressure switch manifold assemblies, it would be desirable to have an assembly which requires fewer connections to make and parts to assemble and which, generally, is less expensive yet inherently more reliable.

SUMMARY OF THE INVENTION

It is therefore an object of the invention to provide a pressure switch manifold assembly particularly adapted for use with automotive transmissions which is inexpensive yet has improved reliability, one which is particularly conducive to mass manufacturing techniques. Yet another object is the provision of a method of making such pressure switch manifold assemblies which have improved yield in production as well as having reduced material cost.

Briefly, in accordance with the invention, a lead frame of electrically conductive material is formed into a plurality of circuit paths which include a plurality of center contacts extending from respective paths into outer partial or discontinuous annular contacts of different respective circuit paths. Each center contact has a central portion displaced vertically from the outer marginal portion of the center contact a distance equal to and preferably in excess of a selected distance between the central portion and a reference related to the position of the respective annular contact. The lead frame is inserted into a mold with each discontinuous annular contact received on a reference surface of the mold to fix the vertical position thereof and with the outer marginal portion of each center contact clamped at a selected vertical position. A pin is placed in the mold for each center contact and when the mold is closed the pins engage and deform each respective central portion as necessary toward the respective marginal portion of each center contact to fix the vertical position thereof relative to each discontinuous annular contact. Suitable electrically insulative resinous material is then injected into the mold to form the base assembly. Runners joining various circuit paths are then severed as by piercing them through aligned holes in the resinous overmold. A snap acting disc is placed on each discontinuous annulus and is retained there by a sheet of Kapton or other suitable material. A sealing member in the form of an O-ring is placed over the Kapton sheet and staked to the overmold material to complete the assembly.

Preferably, the lead frame is coated with suitable material such as tin at selected locations to facilitate use as a connector portion. According to a feature of the invention, selected circuit paths can be formed into bonding pads so that a thermistor can be attached and overmolded, if desired.

The resulting assembly utilizes a single sheet of lead frame material to form both outer and center contacts vertically spaced from one another to provide appropriate switching of a snap acting disc, typically on the order of 0.002".

Other objects, features, and advantages of the invention will be apparent from the following detailed description taking in conjunction with the accompanying drawings, wherein like reference numerals refer to like parts.

BRIEF DESCRIPTION OF THE DRAWINGS

With reference to FIGS. 1–4, a lead frame 8 is formed into selected pattern of circuit paths or leads by stamping or etching a sheet of electrically conductive material such as brass. The pattern includes a selected number of normally open switching stations 10*a*–10*e* each having an outer, preferably discontinuous or partial annulus 12 and a lead of a respective center contact 14 extending through the discontinued portion of the respective annulus with the contact being centered therewithin. It will be understood that the number of switching stations is a matter of choice and may vary from one application to another. Further, the annulus could be continuous, if desired, with the lead from the center contact configured to pass under the annulus. The discontinuous annuli 12 are interconnected by a lead 16 which extends to a ground tab 18. The center contacts of switches 10*a* and 10*b* are interconnected by lead 20 which extends to integral connector pin C. Center contacts of switch stations 10*c* and 10*d* are interconnected by lead 22 which extends to integral connector pin A. The center contact of switch station 10*e* is connected to lead 24 which extends to integral connector pin B. It will be understood that, if desired, the polarity of the center contacts 14 and annuli 12 can be inverted.

A separate lead 26 is shown extending from a connection tab 28 to integral connector pin D. In the particular application with which the manifold assembly shown is used the provision of lead 26 and connecting tab 28 allows the connection of a separate discrete switch having an opposite switching logic; however, it will be realized that some applications will have only normally open switches of the type used in switch stations 10*a*–10*e* while others may call for additional normally closed switches for which additional connector tabs could be provided. The provision of suitable normally closed switches will be discussed below with particular reference being made to FIGS. 6 and 7.

Figure 1:
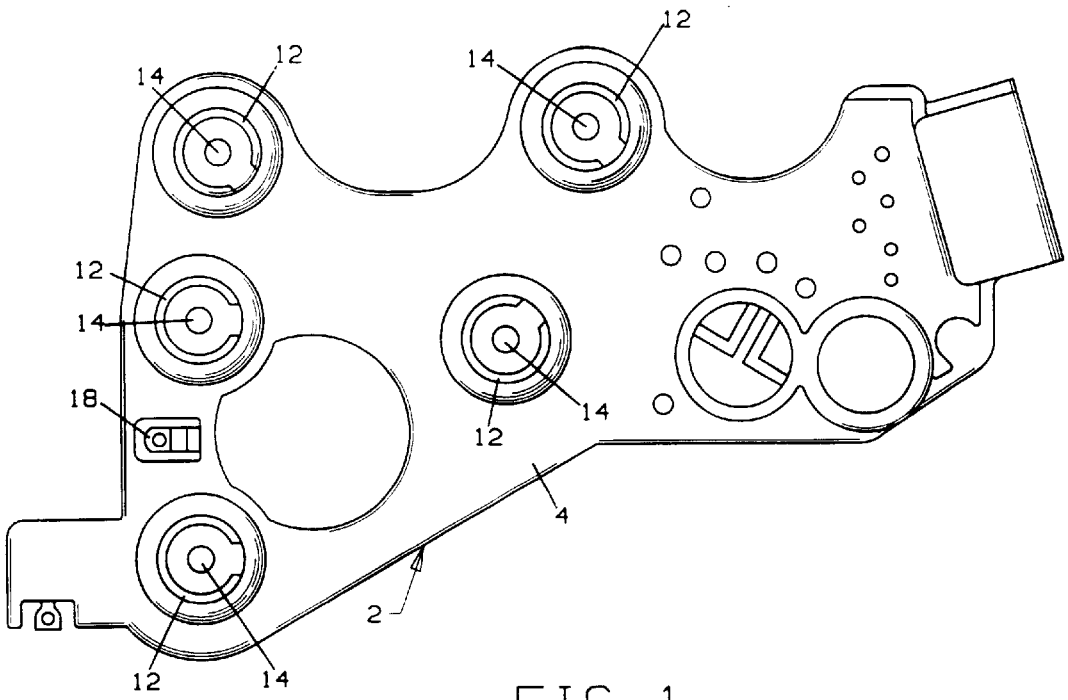
FIG. 1 is a top plan view of a pressure switch manifold assembly shown as it is taken from a mold without the pressure responsive discs and seals and without a thermistor.
Figure 2:
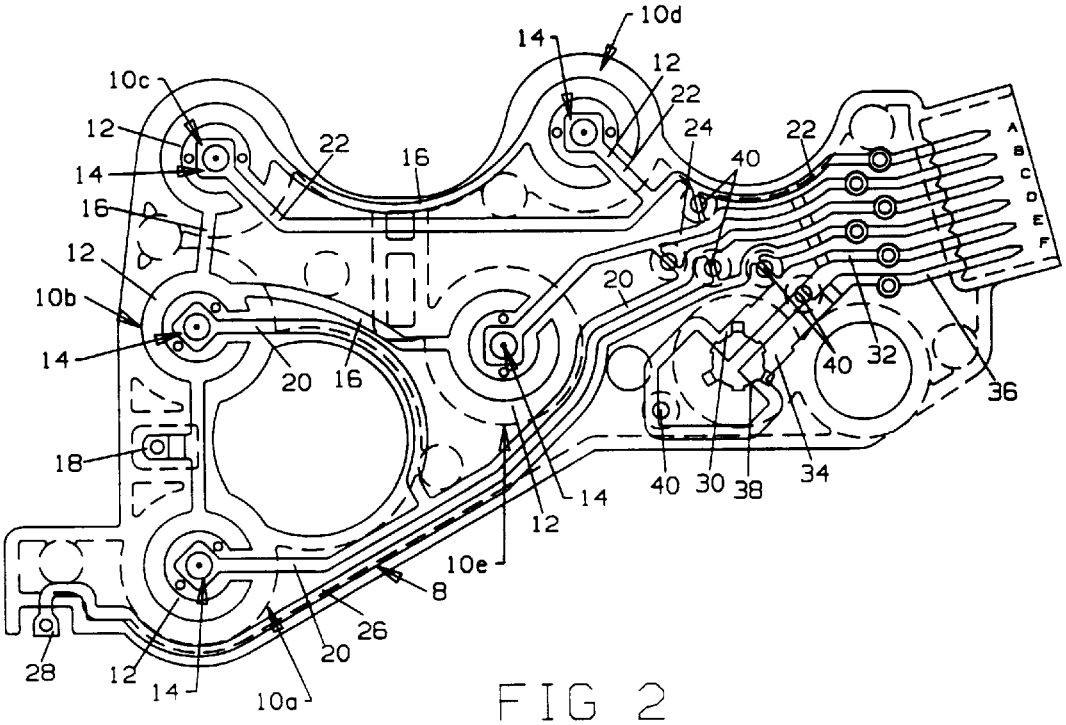
FIG. 2 is a view similar to FIG. 1 but showing the location of the several circuit paths.
Figure 3:
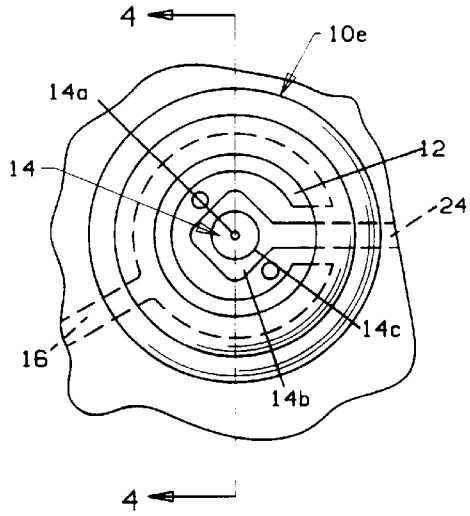
FIG. 3 is an enlarged top plan view of a normally open switching stations shown in FIG. 2.

Also shown in FIG. 2, are first and second bonding pads 30, 34 which are connected to respective leads 32, 36 in turn extending to respective integral connector pins E and F. Bonding pads 30, 34 are intended for use with an optional thermistor 38. If used, the thermistor leads are bonded in a conventional manner as by welding, to the bonding pads and then the thermistor and bonding pads are overmolded along with the remainder of the assembly as will be discussed below. Further information on an overmolded thermistor of the type shown can be had in copending U.S. patent application Ser. No. 08/062,644, assigned to the assignee of the present invention.

In order to handle the various leads prior to overmolding and maintain them in selected, spaced orientation relative to one another, the leads are interconnected at selected locations, such as by interconnecting runners 40. Apertures are formed in the overmolding in alignment with the runners 40 so that they can be severed once the molding procedure has been completed. With respect to the switch stations, as best seen in FIG. 4, each discontinuous annulus has an outer peripheral portion 12*a* which is embedded in the plastic overmold support 43 with an inner peripheral portion 12*b* which has an exposed upper surface to serve to physically support and electrically engage a disc 42, to be discussed below.

Figure 4:
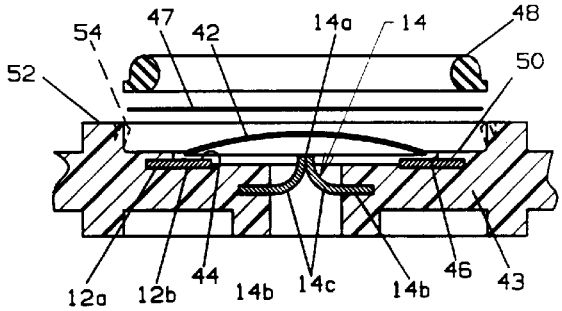
FIG. 4 is a cross section taken on line 4—4 of FIG. 3 and shown with a pressure responsive disc, an impervious, flexible sheet of electrically insulating material and a seal member blown apart.

Electrically conductive, pressure responsive snap acting discs formed of suitable material such as stainless steel, such as disc 42 shown in FIG. 4, are used as the switching elements. Such discs are formed with dished curvatures, e.g., upwardly convex as shown in the figure and are adapted to move to an oppositely dished configuration, i.e., downwardly convex (not shown) when subjected to a selected level of fluid pressure. In order for the disc to function properly as a switching element in a normally open switch the central portion 14*a* of a respective center contact 14 must be spaced vertically below the respective discontinuous annular portion 12 a selected distance, e.g., on the order of 0.002". As shown, contact 14 is formed with a central portion 14*a* raised above its outer peripheral portion 14*b* serving as a retention flange. An intermediate portion 14*c* of contact 14 is clamped when the lead frame is placed in a mold at a position such that central portion 14*a* is spaced equal to or, preferably slightly more than the selected vertical distance above the reference, e.g., plane 44 shown in FIG. 4, the top surface of discontinuous annulus 12. Then a pin is brought down in the mold to engage and deform central portion 14*a* downwardly as necessary to the selected vertical position.

Figure 5:
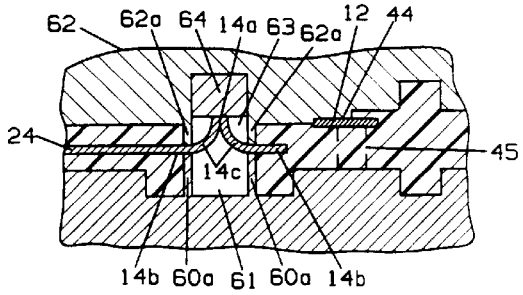
FIG. 5 is a cross sectional view of a portion of a mold in which the assembly is overmolded.

More specifically, with reference to FIG. 5, the lead frame comprising the several current paths is placed in a mold half 60 with the center contacts 14 each received in a well portion 61 and with intermediate marginal portion 14*c*, separating the central portion 14*a* from the marginal retention portion 14*b*, resting on clamping rib portion 60*a*. A second mold half 62 has well portions 63 aligned with respective well portions 61 and clamping ribs 62*a* aligned with respective clamping ribs 60*a* to securely clamp each respective center contact 14 at the intermediate marginal portion 14*c*. A gauge pin 64 having a precise height selected relative to the vertical position of reference plane 44 is disposed in each well portion 63 so that when mold half 62 is closed against mold half 60 after the lead frame has been placed therein each pin 64 will engage its respective center contact and deform it as necessary to a precise vertical position relative to the reference plane 44. The vertical position of discontinuous annulus is determined by the bottom wall of mold half 62 in cooperation with pin 45. The original height of a central portion 14*a* above intermediate marginal portion 14*c* prior to molding is chosen to be at least equal to and preferably slightly greater than that called for in order to comprehend variation in insert stamping developed height.

Upon final assembly, a disc 42 is placed in each switching station within a seat 46 formed in the overmold, a layer 47 of Kapton or other suitable flexible, electrically insulative material is placed on top of the disc and an elastomeric sealing element 48 is placed onto seat 50. Element 48 is locked in place by staking over at least a portion of rib 52 formed in the overmold material (see dashed line 54 in FIG. 4). Further information on the sealing element and means for locking it in place can be obtained in U.S. Pat. No. 5,280,926, assigned to the assignee of the present invention, which is incorporated herein by this reference.

Figure 6:
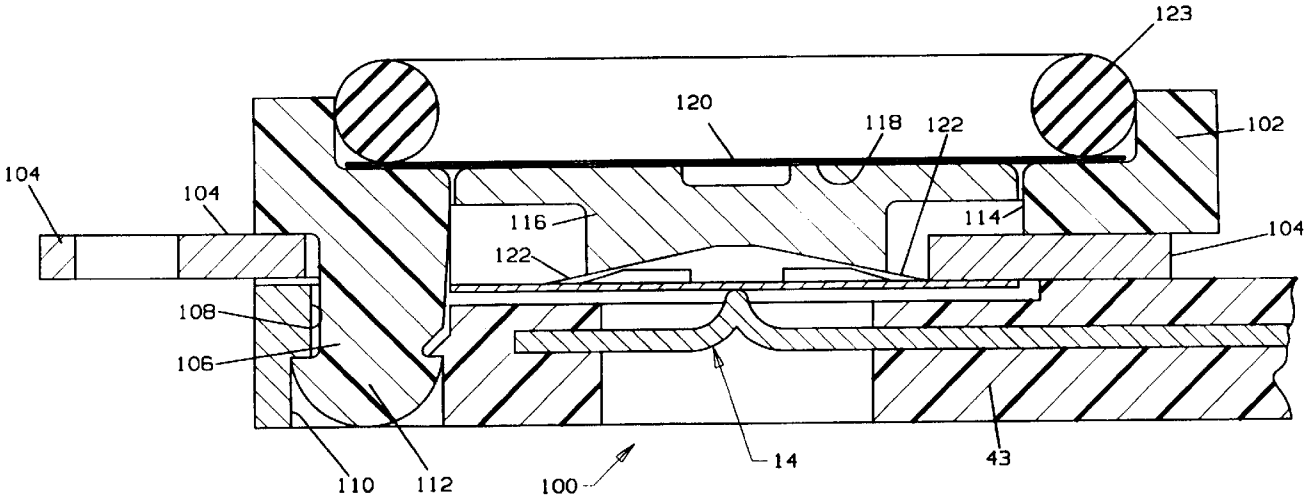
FIGS. 6 and 7 are cross sectional views of normally closed switches which can be used in switch assembly made in accordance with the invention.

As mentioned above, certain applications call for normally closed pressure responsive switches in addition to the normally open switches shown in FIGS. 1–4. FIG. 6 shows a normally closed switch assembly 100 in which the center contact 14 is made as part of the lead frame in the same manner as described above with reference to FIGS. 1–5. An upper body member 102 is placed on overmold support 43 with a combination terminal/disc seat 104 sandwiched therebetween. Body 102, formed of electrical insulating material such as a suitable plastic has a plurality of downwardly depending legs 106 (one being shown in FIG. 6) which are received in respective apertures 108 formed in overmold support 43. Apertures 108 are formed with a counterbore 110 so that legs 106 can be deformed at their free distal end 112 to securely lock body 102 to support 43. An electrically conductive, snap acting disc 42 is disposed between terminal/disc seat 104 and stationary contact 14 and normally is in electrical engagement therewith. Body 102 is formed with a centrally located opening 114 and slidably receives therein a piston member 116 having an upper surface 118 adapted to receive fluid pressure through a flexible diaphragm 120 of Kapton or other suitable material. Lower portion 122 of piston 116 is adapted to place a force on the outer peripheral portions of disc 42 as the fluid pressure received on diaphragm 120 increases and causes piston member 116 to slide toward disc 42 eventually causing the disc to snap out of engagement with terminal/disc seat 104 to open the switch. A suitable elastomeric seal member, such as O-ring 123 is placed on top of diaphragm 120 to seat the switch when placed over a pressure port. End 124 of terminal/disc seat member 104 is then connected to tab 28 of FIG. 1 in a suitable manner. Similar modular, normally closed switches are shown in coassigned U.S. Pat. No. 5,049,708, the subject matter of which is incorporated by this reference. In that patent, the center contact members are individually formed. Such switches could also be used with the normally open switch assembly of FIGS. 1–4, if desired.

Figure 7:
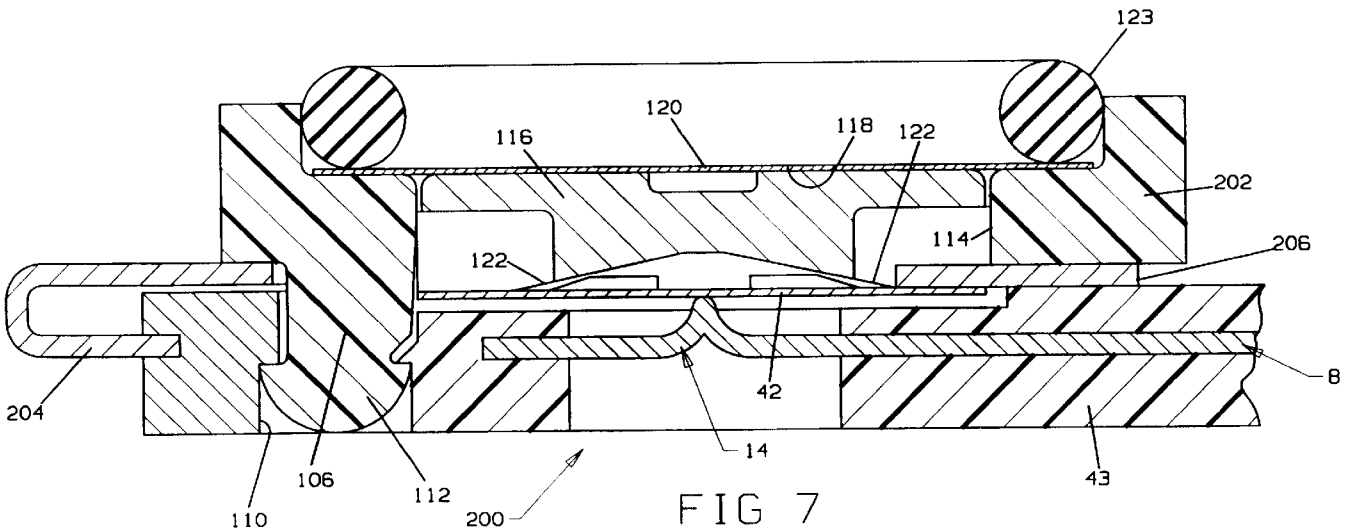

According to a modified embodiment of the invention, a normally closed pressure responsive switch can be made in which both the center contact and the disc seat member are formed from the lead frame. As seen in FIG. 7, lead frame 8 of switch assembly 200 includes an interconnecting lead 20, 22 24 of FIG. 2, lead to center contact 14. Lead frame 8 also includes an extended portion 204 separable from other portions of lead frame 8 through a suitable runner 40 (not shown). Extended portion 204 is bent back 180° and formed with a distal end 206 received on the top surface of support 43 to serve as a disc seat. As seen in the figure, disc 42 is disposed between the bottom surface of distal end 206 and center contact 14. The remaining parts of the switch are described in relation to FIG. 6 and need not be repeated. It will be seen that a normally closed switch made in accordance with FIG. 7 also has the advantage of reducing the number of interconnectors normally required.

A pressure switch manifold assembly made in accordance with the invention has an advantage of having fewer parts which result in improved reliability. The switching stations are less likely to be affected by contamination since fewer parts are involved in assembly with concomitant less handling. Handling of discrete normally open switches is avoided and the pressure switch is sealed after assembly. Potential failure modes of shorting a disc seat or lower contact to a bracket, or disc seat to the lower contact (external to the switch) are eliminated. The insulator, lower contacts, and disc seats serve as one component to thereby reduce the parts count. The switch insulator rivets formerly used to assemble housing parts together are eliminated. The lead frame used for the circuit paths perform several functions including acting as pressure switch contact members, providing connector blades or pins to mate with connecting terminals and provide an area on which to weld a leaded thermistor. The lead frame is preferably tin plated on selected areas which include the connector pin and thermistor area. This could also be accomplished using two separate lead frames, if desired, one having the desirable plated base metal for the connector and thermistor areas and the other having the desired plated base metal for the contact members in the pressure switches. The two separate lead frames could be joined together in a conventional fashions by riveting prior to overmolding with plastic, to obtain the desired circuitry.

Various modifications of the embodiments described are possible within the scope of the invention claimed. It is the intention that the appended claims be interpreted as broadly as possible in view of the prior art to include all such variations and modifications.

We claim:

1. A method for making a pressure switch assembly having at least one switching station comprising the steps of forming a lead frame into a plurality of circuit paths, forming at least one center contact on the distal end of a circuit path of said plurality of circuit paths disposed in alignment with the at least one switching station, the at least one center contact having an upwardly extending projection circumscribed by a retention flange and an intermediate portion therebetween, the upwardly extending projection extending vertically to a selected position relative to a reference plane, forming an electrically conductive disc seat member on another circuit path for the at least one switching station and disposing the disc seat member around the at least one center contact, placing the plurality of circuit paths in a mold with the disc seat member of the at least one switching station referenced against a first stop surface, clamping the intermediate portion of the at least one center contact to maintain the intermediate portion at a selected location, moving a gauge surface from a position above the reference plane downwardly to the reference plane against the upwardly extending projection to insure that the upwardly extending projection is spaced at a selected vertical distance relative to the disc seat member, molding electrically insulating material around the lead frame including a portion of the at least one center contact leaving exposed the upwardly extending projection and at least a portion of the disc seat member.

2. A method according to claim 1 including the step of forming distal end portions of at least some of said plurality of circuit paths into pin configurations to serve as connectors.

3. A method according to claim 2 in which the distal end portions of the at least some of said plurality of circuit paths are tin plated.

4. A method according to claim 1 in which at least some of the circuit paths are interconnected by runners when the insulating material is molded around the lead frame and including the step after molding of severing the runners to electrically separate the circuit paths from one another.

5. A method according to claim 1 including the steps of forming first and second circuit paths of said plurality of circuit paths from portions of the lead frame which have been tin plated and extending the tin plated first and second circuit paths into a thermistor area.

6. A method according to claim 1 in which the electrically conductive disc seat member is a partial annulus.

7. A method according to claim 1 including the step of bending a portion of the lead frame generally 180° so that said portion of the lead frame extends over the at least one center contact to serve as a disc seat for an electrically conductive disc to be placed between the at least one center contact and the lead frame portion.

8. A method according to claim 1 in which the disc seat member is bent generally 180° to extend back over the at least one switching station to provide a normally closed switching station.

9. A pressure switch assembly comprising an electrically insulating base, a plurality of circuit paths embedded in the base, at least one switching station including a center contact having an upwardly extending projection surrounded by a retention flange, the retention flange embedded in the base with the upwardly extending projection extending out of the base, an electrically conductive disc seat member disposed around but spaced from the center contact of the at least one switching station with at least a portion of the disc seat member extending out of the base, the base forming a rib surrounding said at least one switching station, an electrically conductive disc movable between first and second configurations received on the disc seat member, a layer of flexible insulating material disposed over the electrically conductive disc and extending essentially to the rib surrounding the at least one switching station, a generally O-shaped elastomeric sealing member lockingly received on the layer of flexible material and disposed contiguous with the rib surrounding the at least one switching station, said disc seat member comprising a circuit path portion of said plurality of circuit paths bent generally 180° so as to extend over said center contact, the electrically conductive disc disposed between the disc seat member and the center contact.

10. A pressure switch according to claim 9 in which the electrically conductive disc seat member is a partial annulus.

11. A pressure switch assembly according to claim 9 in which the base is formed of first and second portions, the first portion of the base has the plurality of circuit paths embedded in it and the disc seat member extends out of it, the second portion of the base is attached to the first portion of the base with the disc seat member therebetween, and a movable piston member is disposed in the second portion of the base member between the layer of flexible material and the electrically conductive disc.

12. A pressure switch assembly according to claim 9 in which a movable piston member is disposed between the layer of flexible material and the electrically conductive disc member.

* * * * *